US005159734A

United States Patent [19]

Whitt et al.

[11] Patent Number: 5,159,734

[45] Date of Patent: Nov. 3, 1992

[54] APPARATUS FOR CLEANING ROLLS

[75] Inventors: Riley S. Whitt, Spartanburg, S.C.; William L. Bridges, Lynn, N.C.; Marshall L. Johnson, Spartanburg, S.C.

[73] Assignee: Milliken Research Corporation, Spartanburg, S.C.

[21] Appl. No.: 884,869

[22] Filed: May 13, 1992

Related U.S. Application Data

[63] Continuation of Ser. No. 605,807, Oct. 30, 1990, abandoned.

[51] Int. Cl.[5] ..... A46B 13/02

[52] U.S. Cl. ..... 15/883; 15/3.17; 15/88; 15/104.04

[58] Field of Search ..... 15/3.1–3.21, 15/59, 70, 77, 88, 88.3, 88.4, 104.04

[56] References Cited

U.S. PATENT DOCUMENTS

| | | | |
|---|---|---|---|
| 1,025,062 | 4/1912 | Howard | 15/3.2 |
| 2,035,587 | 3/1936 | Brandenburg | 15/3.17 |
| 2,221,676 | 11/1940 | Griffith | 15/3.17 |
| 2,221,682 | 11/1940 | Sias | 15/3.17 |
| 2,357,892 | 9/1944 | Grant | 15/3.2 |
| 2,526,542 | 10/1950 | Davies | 15/88 |
| 2,624,059 | 1/1953 | Pierce | 15/3.2 |
| 2,976,550 | 3/1961 | Silver et al. | 15/3.11 |
| 3,928,064 | 12/1975 | Holm | 15/77 |

*Primary Examiner*—Edward L. Roberts
*Attorney, Agent, or Firm*—Kevin M. Kercher; H. William Petry

[57] ABSTRACT

An apparatus for cleaning rolls comprising a plurality of cylindrical brushes that are rotated by a combination of sheaves and belts or their equivalent, which are powered by some form of a motor and uses a solvent to remove debris, such as residual fiber affixed to the rolls.

21 Claims, 2 Drawing Sheets

*FIG. —1—*

APPARATUS FOR CLEANING ROLLS

BACKGROUND OF THE INVENTION

The present invention is directed to an apparatus for cleaning rolls. An example of this type of roll would be a roll used in drawing fiber into yarn.

Cleaning of rolls used in the drawing process can be a time consuming and costly process. A coating of fiber can render the drawing roll ineffective in a relatively short period of time. Manually cleaning the rolls can be very time consuming and if not performed carefully can result in a haphazard job that has serious deleterious effects on quality. Furthermore, multiple rolls cannot be cleaned simultaneously.

The present invention solves these problems and others in a manner not disclosed in the known prior art.

SUMMARY OF THE INVENTION

An apparatus for cleaning rolls comprising a plurality of cylindrical brushes that are rotated by a combination of sheaves and belts or their equivalent, which are powered by some form of a motor and uses a solvent to remove debris, such as residual fiber affixed to the rolls.

It is an advantage of this invention to be able to clean a roll quickly.

It is another advantage of this invention to be able to clean a roll thoroughly.

Yet another advantage of this invention is that it can clean multiple rolls simultaneously.

Still another advantage of this invention is that a roll can be cleaned with relative ease and minimal amount of processing steps.

These and other advantages will be in part obvious and in part pointed out below.

BRIEF DESCRIPTION OF THE DRAWINGS

The above as well as other advantages of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
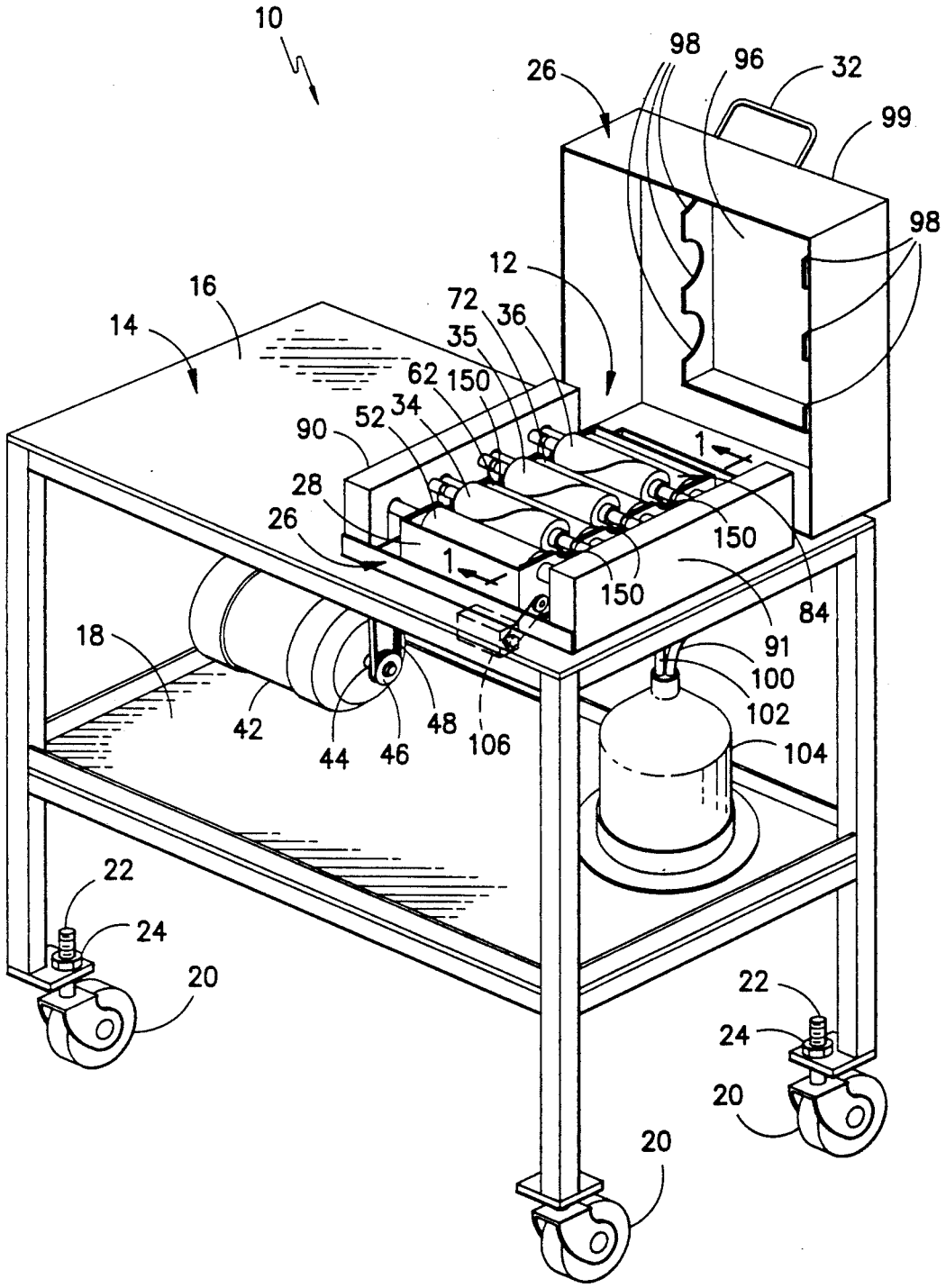
FIG. 1 represents a perspective elevational view of an embodiment encompassing the present invention including apparatus, cart, and solvent container.
Figure 3:
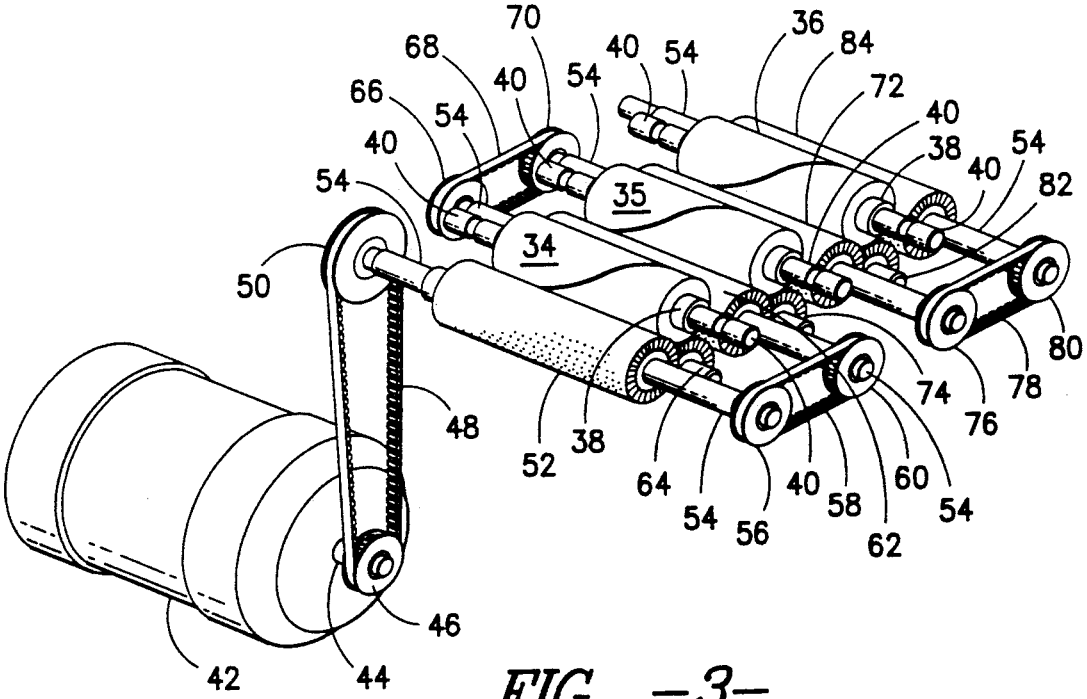
FIG. 3 represents a perspective view of the motor, drive means, brushes and rollers isolated from the supporting structure.

Referring now by reference numerals to the drawings and first to FIG. 1, it will be understood that the roll cleaning apparatus is generally indicated as 10. This invention can clean any type of roll, but is primarily directed to the cleaning of rolls used in a drawing process that converts fibers into yarn. These draw rolls 34, 35 and 36 are approximately eight inches in length, but can be of any dimension. The rolls 34, 35, and 36 have a groove which spirals along the face of the rolls 34, 35 and 36, as shown in FIGS. 1 and 3, which draw the fibers into the form of yarn. The draw rolls have an outer cylindrical casing preferably made of acrylonitrile, which is a form of synthetic rubber, but could be made of any material that would apply sufficient pressure to draw yarn. There is an inner cylindrical core 38 preferably made of metal or a similar material with reduced diameter extensions forming shafts 40 on each opposing end of the cylindrical core 38.

The roll cleaning apparatus 10 comprises a cleaning mechanism 12 that is mounted to top layer 16 of a cart 14. This cart 14 can be any type of supporting structure. In the preferred embodiment, having the cart 14 mounted on rollers 20 provides flexibility and economy. The rollers 20 can be attached to the cart 14 by any conventional means, such as a threaded bolt-like extension 22 and nut 24.

Figure 2:
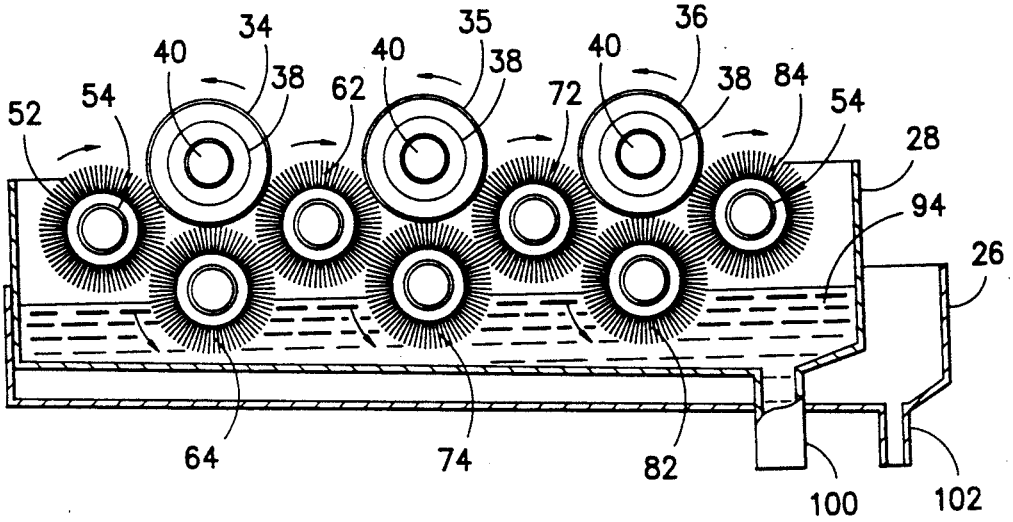
FIG. 2 represents a sectional view of the present invention taken on line 1—1 of FIG. 1.

The cleaning mechanism 12 comprises an outer container 26 and an inner container 28, as shown in FIGS. 1 and 2. The outer container 26 has a cover 99 that encloses the entire cleaning mechanism 12 and is lifted up and down by means of a handle 32.

The cleaning mechanism 12 is preferably powered by a one-third horsepower electric motor 42, although a large variety of motor sizes would suffice and they may be pneumatic, hydraulic, and so forth. There is a toothed sheave 46 attached to the rotor 44 of the motor 42. There is a continuous belt 48 having a notched inner surface that connects sheave 46 to another sheave 50 that is mounted to a first roller brush 52 at one end of a smaller diameter extension rod 54. There is a smaller diameter extension rod 54 located at each opposing end of roller brush 52 as well as roller brushes 62, 72, and 84. Although, a belt and sheave combination is used as a mechanical interconnection throughout this invention, any similar means will suffice such as a continuous linked chain and gear combination, and so forth.

The opposite end of roller brush 52 also has a sheave 56 attached thereto that is connected by means of a notched belt 58 to an identical sheave 60 attached to a second roller brush 62 that is also substantially similar to roller brush 52, but not necessarily so. There is a third roller brush 64 that is located between and slightly below the first roller brush 52 and the second roller brush 62, as shown in FIGS. 2 and 3. The third roller brush 64 is rotated by the friction of roller brush 52 and roller brush 62 and in the opposite direction, as shown in FIG. 2. Roller brush 64 is not connected to any pulley-type drive means extending from the motor 42.

The opposite end of the second roller brush 62, which is on the left hand side of roller brush 62, as shown in FIG. 3, also has a another sheave 66 and associated belt 68 that is connected to a sheave 70 that is connected to a fourth roller brush 72. As before, there is a fifth roller brush 74 located below and between the second roller brush 62 and the fourth roller brush 72 in the same manner as roller brush 64.

The opposite end of the fourth roller brush 72, which is on the right hand side of roller brush 72 as shown in FIG. 3, also has another sheave 76 and associated belt 78 that is connected to a sheave 80 that is connected to a sixth roller brush 84. As before, there is a seventh roller brush 82 located below and between the fourth roller brush 72 and the sixth roller brush 84 in the same manner as roller brushes 64 and 74.

The opposite end of the sixth roller brush 84, which is on the left hand side of roller brush 84 as shown in FIG. 3, does not have any sheave attached to it so that the extension rod 54 of roller brush 84 is allowed to spin unencumbered.

The brushes 52, 62, 64, 72, 74, 80, 82 and 84 are covered with nylon bristles, but could be covered with any similar synthetic or natural material that would remove fibrous material from a draw roll.

Referring now to FIG. 2, draw roll 34 is cleaned by the rotating operation of the first roller brush 52 on one side of draw roll 34, the second roller brush 62 on the other side of draw roll 34 and the third roller brush 64 located directly underneath draw roll 34. Draw roll 35 is cleaned by the rotating operation of the second roller brush 62 on one side of draw roll 35, the fourth roller brush 72 on the other side of draw roll 35 and the fifth roller brush 74 located directly underneath draw roll 35. Draw roll 36 is cleaned by the rotating operation of the fourth roller brush 72 on one side of draw roll 36, the sixth roller brush 84 on the other side of draw roll 35 and the seventh roller brush 82 located directly underneath draw roll 36.

The rollers 52, 62, 64, 72, 74, 82 and 84 are all mounted in parallel within the inner container 28 in which outer ends of the extension rods 54 of roller brushes 52, 62, 72 and 84 and sheaves 50, 56, 60, 66, 70, 76, and 80 are completely enveloped in a first and second rectangular metal containers 90 and 91 respectfully. The rectangular metal containers 90 and 91 are enclosed by the outer cover 99, as shown in FIG. 1.

There is an inner container 28 that has four sides and is open at the top. The roller brushes 52, 62, 64, 72, 74, 82 and 84 are held in place and rotate within the inner container 28 with apertures in the inner container 28 that allows the rod extensions 54 of brushes 52, 62, 72 and 84 to protrude out into the rectangular metal containers 90 and 91 as shown in FIGS. 1 and 2. The inner container 28 has an inner cover 96 that is welded to the inside of cover 99. There are notched half circle indentations 150 in the inner container 28 as well as notched half circle indentations 98 in the inner cover 96 to allow draw rolls 34, 35, and 36 to extend outside of the side walls of the inner container 28. The inner container 28 can hold a cleaning solvent 94 such as isopropyl alcohol or similar chemical, which is transferred to the draw rolls 34, 35, and 36 by means of brush rollers 64, 74 and 82. Solvent 94 can be drained into a bottle 104 that is mounted on the bottom layer 18 of cart 14 by means of a tube 100, constructed out of rubber or equivalent flexible material, connected to a valve (not shown). The bottom of outer container 26 acts as an overflow drain for solvent 94 that spills out of the inner container 28 as shown in FIG. 2. There is an additional hose line 102 that runs from the outer container 26 to the bottle 104.

There is a safety switch 106 that is triggered by a latch (not shown) mounted to the cover 99 that operates to cutoff power to the motor 42 when the cover 99 is raised.

In view of the above, it will be seen that various aspects and features of the invention are achieved and other advantageous results attained. While a preferred embodiment of the invention has been shown and described, it will be clear to those skilled in the art that changes and modifications may be made therein without departure from the invention in its broader aspect.

What is claimed is:

1. An apparatus for cleaning rolls comprising:

(a) a container;

(b) a first cylindrical roller brush rotatably mounted about a fixed axis within said container in a substantially horizontal plane and said first cylindrical roller brush has a first and a second end portion;

(c) a second cylindrical roller brush rotatably mounted in said substantially horizontal plane and in spaced relationship from said first cylindrical roller brush within said container and said second cylindrical roller brush has a first and a second end portion;

(d) a third cylindrical roller brush rotatably mounted about a fixed axis below said substantially horizontal plane and between said first cylindrical roller brush in frictional contact therewith and said second cylindrical roller brush in frictional contact therewith such that one of said rolls can be supported by said first, second and third cylindrical roller brushes for cleaning within said container and said third cylindrical roller brush has a first and a second end portion;

(e) a means for rotating said first roller brush in a first rotational direction and a means for rotating said second roller brush in said first rotational direction thereby rotating said third roller brush in a second rotational direction opposite to said first rotational direction.

2. An apparatus for cleaning rolls as defined in claim 1, further comprising a first connecting means rotatably coupling said second end portion of said first cylindrical roller brush to said second end portion of said second cylindrical roller brush.

3. An apparatus for cleaning rolls as defined in claim 2, wherein said first connecting means further comprises a first sheave mounted on said second end portion of said first cylindrical roller brush and a second sheave mounted on said second end portion of said second cylindrical roller brush and a continuous belt rotatable mounted between said first sheave and said second sheave.

4. An apparatus for cleaning rolls as defined in claim 2, wherein said first connecting means further comprises a first gear mounted on said second end portion of said first cylindrical roller brush and a second gear mounted on said second end portion of said second cylindrical roller brush and a continuous chain rotatable mounted between said first gear and said second gear.

5. An apparatus for cleaning rolls as defined in claim 1, wherein said means for rotating said first cylindrical roller brush further comprises a first sheave mounted on said first end portion of said first roller brush and a second sheave mounted on a shaft of a motor and a continuous belt rotatable mounted between said first sheave and said second sheave.

6. An apparatus for cleaning rolls as defined in claim 5, in which said motor is electric.

7. An apparatus for cleaning rolls as defined in claim 1, wherein said means for rotating said first cylindrical roller brush further comprises a first gear mounted on said first end portion of said first roller brush and a second gear mounted on a shaft of a motor and a continuous chain rotatable mounted between said first gear and said second gear.

8. An apparatus for cleaning rolls as defined in claim 7, in which said motor is electric.

9. An apparatus for cleaning rolls as defined in claim 1, in which said container is adapted to received cleaning fluid whereby said third cylindrical roller brush partially immersed in said cleaning fluid can provide said cleaning fluid to said first cylindrical roller brush, said second cylindrical roller brush and said rolls.

10. An apparatus for cleaning rolls as defined in claim 9, in which said container is enclosed within a second container that can function as an overflow drain for said fluid that spills out of said container.

11. An apparatus for cleaning rolls comprising:

(a) a container;

(b) a first cylindrical roller brush rotatably mounted about a fixed axis within said container in a substantially horizontal plane and said first cylindrical roller brush has a first and a second end portion;

(c) a second cylindrical roller brush rotatably mounted about a fixed axis in said substantially horizontal plane and in spaced relationship from said first roller brush within said container and said second cylindrical roller brush has a first and a second end portion;

(d) a third cylindrical roller brush rotatably mounted about a fixed axis below said substantially horizontal plane and between said first cylindrical roller brush in frictional contact therewith and said second cylindrical roller brush in frictional contact therewith such that one of said rolls can be supported by said first, second and third cylindrical roller brushes for cleaning within said container and said third cylindrical roller brush has a first and a second end portion;

(e) a fourth cylindrical roller brush rotatably mounted about a fixed axis in said substantially horizontal plane and in spaced relationship from said second cylindrical roller brush within said container and said fourth cylindrical roller brush has a first and a second end portion;

(f) a fifth cylindrical roller brush rotatably mounted about a fixed axis below said substantially horizontal plane and between said second cylindrical roller brush in frictional contact therewith and said fourth cylindrical roller brush in frictional contact therewith such that one of said rolls can be supported by said second, fourth, and fifth cylindrical roller brushes for cleaning within said container and said fifth cylindrical roller brush has a first and a second end portion;

(g) a sixth cylindrical roller brush rotatably mounted about a fixed axis in said substantially horizontal plane and in spaced relationship from said fourth cylindrical roller brush within said container and said sixth cylindrical roller brush has a first and a second end portion;

(h) a seventh cylindrical roller brush rotatably mounted about a fixed axis below said substantially horizontal plane and between said fourth cylindrical roller brush in frictional contact therewith and said sixth cylindrical roller brush in frictional contact therewith such that one of said rolls can be supported by said fourth, seventh and sixth cylindrical roller brushes for cleaning within said container and said seventh cylindrical roller brush has a first and a second end portion;

(i) a means for rotating said first cylindrical roller brush in a first rotational direction and a means for rotating said second cylindrical roller brush in a first rotational direction and a means for rotating said fourth cylindrical roller brush in a first rotational direction and a means for rotating said sixth cylindrical roller brush in a first rotational direction thereby rotating said third roller brush in a second rotational direction opposite to said first rotational direction and thereby rotating said fifth roller brush in a second rotational direction opposite to said first rotational direction and thereby rotating said seventh roller brush in a second rotational direction opposite to said first rotational direction.

12. An apparatus for cleaning rolls as defined in claim 11, further comprising a first connecting means rotatably coupling said second end portion of said first cylindrical roller brush to said second end portion of said second cylindrical roller brush and a second connecting means rotatably coupling said first end portion of said second cylindrical roller brush to said first end portion of said fourth cylindrical roller brush and a third connecting means rotatably coupling said second end portion of said fourth cylindrical roller brush to said second end portion of said sixth cylindrical roller brush.

13. An apparatus for cleaning rolls as defined in claim 12, wherein said first connecting means further comprising a first sheave mounted on said second end portion of said first cylindrical roller brush and a second sheave mounted on said second end portion of said second cylindrical roller brush and a continuous belt rotatable mounted between said first sheave and said second sheave and said second connecting means further comprising a third sheave mounted on said first end portion of said second cylindrical roller brush and a fourth sheave mounted on said first end portion of said fourth cylindrical roller brush and a continuous belt rotatable mounted between said third sheave and said fourth sheave and said third connecting means further comprising a fifth sheave mounted on said second end portion of said fourth cylindrical roller brush and a sixth sheave mounted on said second end portion of said sixth cylindrical roller brush and a continuous belt rotatably mounted between said fifth sheave and said sixth sheave.

14. An apparatus for cleaning rolls as defined in claim 12, wherein said first connecting means further comprising a first sheave mounted on said second end portion of said first cylindrical roller brush and a second sheave mounted on said second end portion of said second cylindrical roller brush and a continuous chain rotatable mounted between said first gear and said second gear and said second connecting means further comprising a third gear mounted on said first end portion of said second cylindrical roller brush and a fourth gear mounted on said first end portion of said fourth cylindrical roller brush and a continuous chain rotatable mounted between said third gear and said fourth gear and said third connecting means further comprising a fifth gear mounted on said second end portion of said fourth cylindrical roller brush and a sixth gear mounted on said second end portion of said sixth cylindrical roller brush and a continuous chain rotatable mounted between said fifth gear and said sixth gear.

15. An apparatus for cleaning rolls as defined in claim 11, wherein said means for rotating said first cylindrical roller brush further comprises a first sheave mounted on said first end portion of said first cylindrical roller brush and a second sheave mounted on a shaft of a motor and a continuous belt rotatable mounted between said first sheave and said second sheave.

16. An apparatus for cleaning rolls as defined in claim 15, in which said motor is electric.

17. An apparatus for cleaning rolls as defined in claim 11, wherein said means for rotating said first cylindrical roller brush further comprises a first gear mounted on said first end portion of said first cylindrical roller brush and a second gear mounted a shaft of a motor and a continuous chain rotatable mounted between said first gear and said second gear.

18. An apparatus for cleaning rolls as defined in claim 17, in which said motor is electric.

19. An apparatus for cleaning rolls as defined in claim 11, in which said container is adapted to received cleaning fluid whereby said third cylindrical roller brush partially immersed in said cleaning fluid can provide said cleaning fluid to said first cylindrical roller brush, said second cylindrical roller brush and said rolls.

20. An apparatus for cleaning rolls as defined in claim 19, in which said container is enclosed within a second container that can function as an overflow drain for said fluid that spills out of said container.

21. An apparatus for cleaning rolls comprising:

(a) a container:

(b) a plurality of pairs of first roller brushes rotatably mounted about a fixed axis in substantially horizontal plane within said container;

(c) a plurality of second roller brushes rotatably mounted about a fixed axis below said horizontal plane, one of each of said second roller brusher positioned between each pair of first roller brushes in frictional contact therewith such that the rolls can be supported by on each side by said first roller brushes and below by said second roller brushes for cleanings; and (d) a means for rotating said plurality of said first roller brushes in a first rotational direction thereby rotating said second roller brushes in a second direction opposite to said first rotational direction.

* * * * *

UNITED STATES PATENT AND TRADEMARK OFFICE

CERTIFICATE OF CORRECTION

PATENT NO. : 5,159,734

DATED : November 3, 1992

INVENTOR(S) : Riley Samuel Whitt, William Lawrence Bridges and Marshall Locklear Johnson It is certified that error appears in the above-identified patent and that said Letters Patent is hereby corrected as shown below:

Column 4,
Claim 3, Line 33, cancel "rotatable", substitute "rotatably"--

Column 4,
Claim 4, Line 41, cancel "rotatable", substitute "rotatably"--

Col. 4,
Claim 5, Line 48, cancel "rotatable", substitute "rotatably"--

Col. 4,
Claim 7, Line 57, cancel "rotatable", substitute "rotatably"--

Col. 6,
Claim 13, Line 21, cancel "rotatable", substitute "rotatably"--

Claim 13, Line 27, cancel "rotatable", substitute "rotatably"--

Col. 6,
Claim 14, Line 37, cancel "sheave", substitute "gear"--

Claim 14, Line 39, cancel "sheave", substitute "gear"--

Claim 14, Line 41, cancel "rotatable", substitute "rotatably"--

Claim 14, Line 52, cancel "rotatable", substitute "rotatably"--

Claim 15, Line 59, cancel "rotatable", substitute "rotatably"--

UNITED STATES PATENT AND TRADEMARK OFFICE

CERTIFICATE OF CORRECTION

PATENT NO. : 5,159,734

DATED : November 3, 1992

INVENTOR(S) : Riley Samuel Whitt, William Lawrence Bridges and Marshall Locklear Johnson It is certified that error appears in the above-indentified patent and that said Letters Patent is hereby corrected as shown below:

Col. 7,
Claim 17, Line 1, cancel "rotatable", substitute "rotatably"--
Col. 6,
Claim 14, Line 46, cancel "rotatable", substitute "rotatably"--

Signed and Sealed this

Sixteenth Day of November, 1993

*Attest:*

*Attesting Officer*

BRUCE LEHMAN

*Commissioner of Patents and Trademarks*